US011369826B1

(12) United States Patent
Foltz

(10) Patent No.: US 11,369,826 B1
(45) Date of Patent: Jun. 28, 2022

(54) ADJUSTABLE TWO-IN-ONE SAFETY SQUAT AND BENCH PRESS BAR

(71) Applicant: Kyle Foltz, Seabright, NJ (US)

(72) Inventor: Kyle Foltz, Seabright, NJ (US)

( * ) Notice: Subject to any disclaimer, the term of this patent is extended or adjusted under 35 U.S.C. 154(b) by 0 days.

(21) Appl. No.: 17/097,557

(22) Filed: Nov. 13, 2020

(51) Int. Cl.

| | |
|---|---|
| ***A63B 21/072*** | (2006.01) |
| ***A63B 23/04*** | (2006.01) |
| ***A63B 21/00*** | (2006.01) |
| *A63B 1/00* | (2006.01) |

(52) U.S. Cl.
CPC ..... *A63B 21/0724* (2013.01); *A63B 21/4047* (2015.10); *A63B 23/0405* (2013.01); *A63B 1/00* (2013.01); *A63B 2023/0411* (2013.01); *A63B 2225/09* (2013.01)

(58) Field of Classification Search
CPC ..... A63B 21/0004; A63B 21/072; A63B 21/0722; A63B 21/0724; A63B 21/0726; A63B 21/0728; A63B 21/075; A63B 21/078; A63B 21/0783; A63B 21/4045; A63B 1/00; A63B 1/005; A63B 1/04; A63B 2225/09; A63B 23/0405; A63B 22/20
See application file for complete search history.

(56) References Cited

U.S. PATENT DOCUMENTS 4,274,628 A * 6/1981 Hoagland ..... A63B 21/0724 482/106
4,360,198 A * 11/1982 Waulters ..... A63B 21/078 482/106
4,890,831 A * 1/1990 Craig ..... A63B 21/0724 482/104
5,257,964 A 11/1993 Petters
D371,586 S 7/1996 Snyder
5,836,858 A 11/1998 Sharff
5,984,843 A * 11/1999 Morton ..... A63B 21/0724 482/104
7,056,268 B2 6/2006 Emick
7,963,891 B1 6/2011 Zeaman
D667,904 S 9/2012 DeFrancisci
D685,865 S 7/2013 Kuhn
D710,956 S 8/2014 Hetrick et al.
D725,722 S * 3/2015 Conaway ..... D21/679
9,504,869 B2 11/2016 Gavigan
9,895,564 B1 * 2/2018 Katz ..... A63B 23/1218
D845,404 S 4/2019 Kuka
(Continued)

*Primary Examiner* — Nyca T Nguyen
*Assistant Examiner* — Zachary T Moore
(74) *Attorney, Agent, or Firm* — Goldstein Law Offices, P.C.

(57) ABSTRACT

A squat and bench press bar includes a horizontal bar, a pair of vertical bars affixed to the horizontal bar, a pair of horizontal rods affixed to the pair of vertical bars, and a pair of weight plates for mounting onto the rods. The vertical bars include a first portion slidably disposed within a second portion forming an adjustable telescopic arrangement that enables a user to configure the squat and bench press bar into a squatting configuration or a bench-pressing configuration. The rods define a lowermost point of the squat and bench press bar such that when the weight plates are mounted onto the rods, a portion of the weight plates is positioned below the rods. The rods define an axle upon which the weight plates may rotate such that a user may move the squat and bench press bar from one position to another without requiring a spotter.

8 Claims, 6 Drawing Sheets

(56) References Cited

U.S. PATENT DOCUMENTS

| | | | | |
|---|---|---|---|---|
| 10,583,317 | B2 | 3/2020 | Amyan | |
| 2004/0242385 | A1* | 12/2004 | Emick | A63B 21/0783 482/106 |
| 2006/0100075 | A1* | 5/2006 | Harsh | A63B 21/0783 482/142 |
| 2009/0215594 | A1* | 8/2009 | Panaiotov | A63B 21/16 482/130 |
| 2013/0065738 | A1* | 3/2013 | Henniger | A63B 21/0728 482/104 |
| 2017/0216653 | A1 | 8/2017 | Parr | |
| 2018/0071563 | A1 | 3/2018 | Swinehart | |
| 2018/0296873 | A1* | 10/2018 | Amyan | A63B 21/4035 |
| 2020/0023225 | A1 | 1/2020 | Sands | |

* cited by examiner

ADJUSTABLE TWO-IN-ONE SAFETY SQUAT AND BENCH PRESS BAR

TECHNICAL FIELD

The present disclosure relates generally to weightlifting devices. More particularly, the present disclosure relates to an adjustable two-in-one squat and bench press bar that allows users to safely utilize the bar to perform squat and bench press exercises without a spotter.

BACKGROUND

Weightlifting or strength training has become an integral part of many people's lives, particularly athletes. Types of weightlifting exercises vary tremendously; however, squatting and bench pressing have become among two of the most important exercises for strength training.

The squat exercise generally requires a rack which holds a weightlifting bar. The weightlifting bar holds weights via its sleeves. To operate the weightlifting bar, a user stands inside the rack and places his/her body under the bar portion of the weightlifting bar. The user centers the weightlifting bar on his/her shoulders and neck and balances the bar with his/her hands. Once the bar is secure on the shoulders and neck, the user extends his/her legs upward to lift the bar from the rack. To complete the exercise, the user squats down trying to keep his/her back as vertical as possible and then stands back up fully extending his/her legs. This exercise can be repeated any number of times with any amount of weight depending on the ability of the user and the workout desired.

The bench press exercise also requires a rack which holds a weightlifting bar. In addition, the bench press exercise requires a bench. The weightlifting bar holds various numbers and sizes of weights via its sleeves. The bench allows a user to lay down on his/her back to operate the bar and complete the exercise. The exercise requires the user to lie horizontal on the bench facing upward and extend his/her arms upward and pick up the weightlifting bar from the rack. Once the weightlifting bar is picked up, the user lowers the bar to his/her chest and then pushes up on the bar to lift the bar back to its original position. This exercise can also be repeated as the ability of the user allows.

One problem with squatting and bench pressing; however, is that they are quite dangerous if completed alone. Therefore, spotters are generally required to assist the user with things like putting the weightlifting bar properly back onto the rack after the exercise is completed or helping the user complete the exercise if the weight or number of repetitions is too great. In this way, if the user cannot complete the exercise and return the weightlifting bar to the rack, the user does not become pinned under the weightlifting bar which contains the weights. Indeed, this could cause severe injury or even death. Therefore, most users must adjust their weightlifting schedule to accommodate someone else's schedule who is willing to spot them during the exercise or ask someone to spot them if exercising at a gym. However, in light of the COVID-19 pandemic this is problematic as a spotter must come within six feet of the user, thereby violating social distancing measures to adequately spot the user.

Therefore, there is a need for a weightlifting device which allows a user to squat and bench press using one bar and complete the exercises safely without the aid of a spotter.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a weightlifting device capable of being utilized interchangeably for both squatting and bench press exercises. Accordingly, the present disclosure provides an adjustable two-in-one squat and bench press bar including a horizontal bar and two telescoping vertical bars for height adjustment of the horizontal bar to adjust the weightlifting bar into squatting and/or bench pressing configurations.

An aspect of an example embodiment in the present disclosure is to provide a weightlifting device capable of being safely rolled out of the way as desired by the user if, for example, the weightlifting bar is too heavy for the user, such that no spotter is necessary while using the weightlifting bar. Accordingly, the present disclosure provides a pair of horizontal rods extending outwardly from the pair of vertical bars. The pair of horizontal rods are adapted to receive and sustain a weight plate thereon. The pair of rods define a lowermost point of the squat and bench press bar such that when a weight plate is positioned on each of the pair of rods, a portion of each of the weight plates is positioned below the pair of rods and the pair of rods define an axle upon which the weight plates may rotate along the surface to transfer the squat bench press bar from one position to another as desired.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
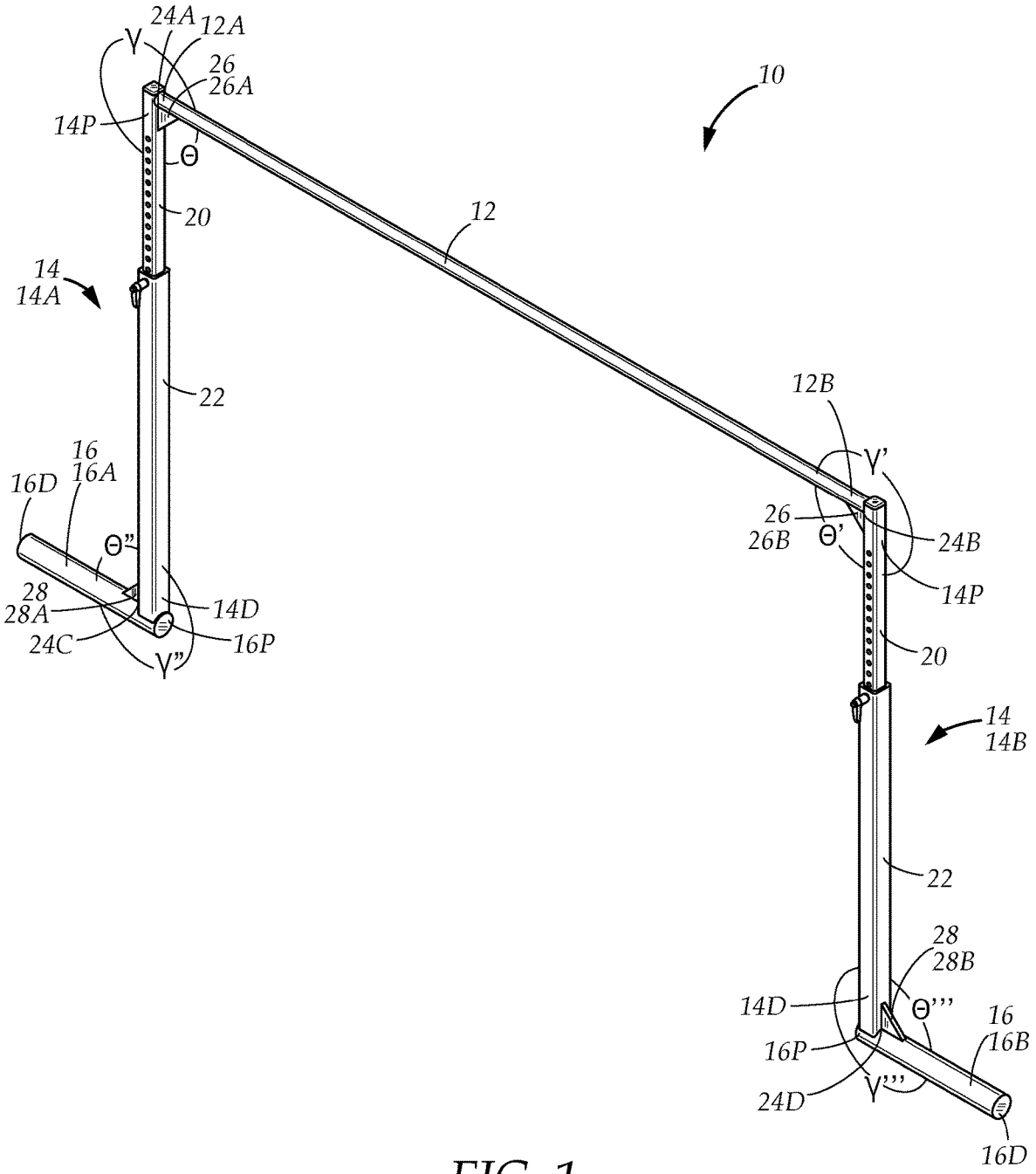
FIG. 1 is a perspective view of the squat and bench press bar according to one embodiment of the present disclosure.
Figure 2:
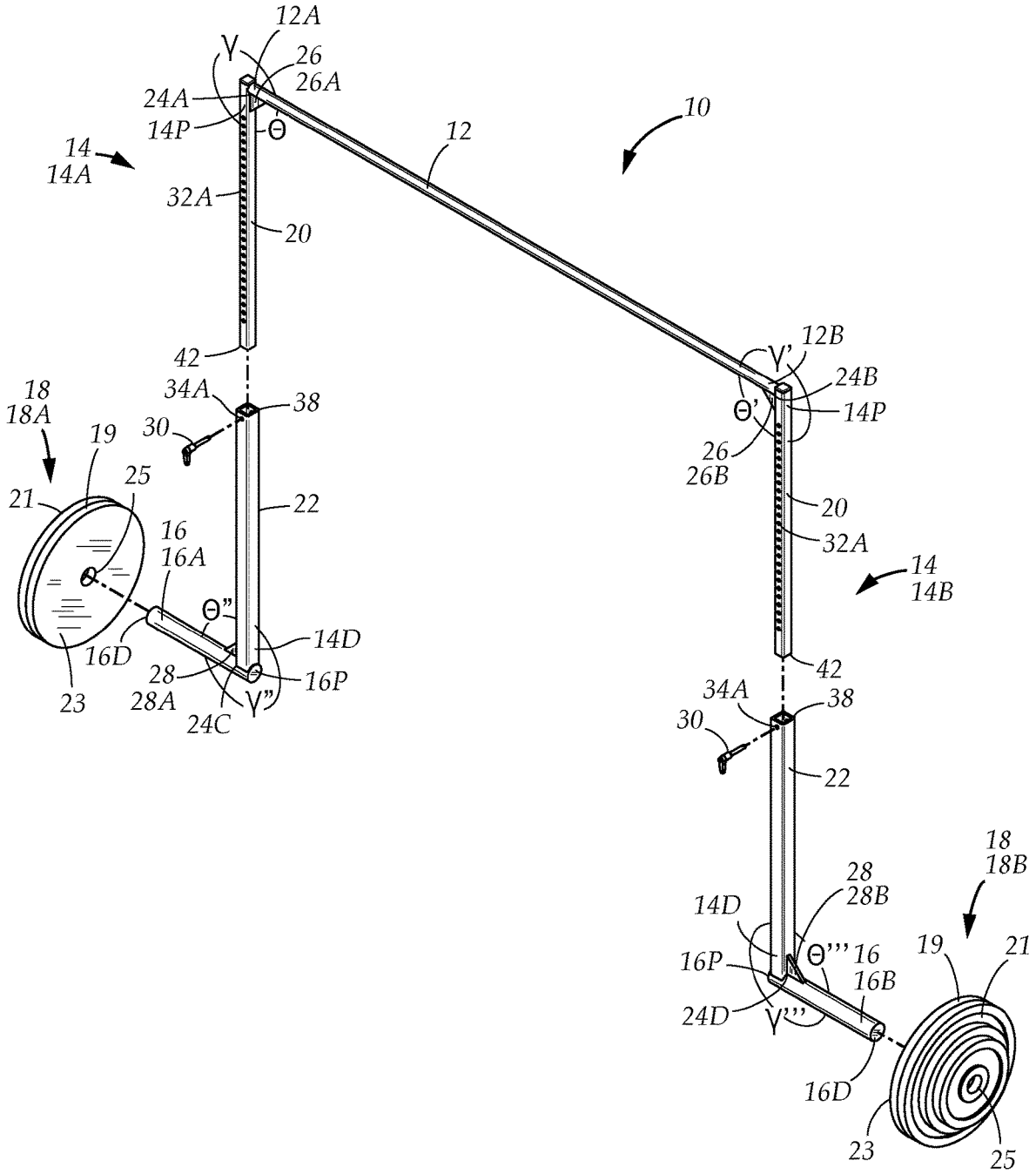
FIG. 2 is an exploded view of the squat and bench press bar, illustrating one manner in which the squat and bench press bar may be assembled according to one embodiment of the present disclosure.

FIG. 1. and FIG. 2 illustrate the squat and bench press bar 10 of the present disclosure. The squat and bench press bar 10 includes an elongated horizontal bar 12, a pair of elongated vertical bars 14 connected to the elongated horizontal bar 12, a pair of horizontal rods 16 connected to the pair of elongated vertical bars 14, and a pair of weight plates 18 for mounting onto the pair of horizontal rods 16 and applying a desired weight onto the squat and bench press bar 10. The elongated horizontal bar 12 includes a first end 12A and a second end 12B opposite the first end 12A. The elongated horizontal bar 12 is circular in cross-sectional shape.

The pair of elongated vertical bars 14 included a first vertical bar 14A extending substantially orthogonally outwardly from the first end 12A of the horizontal bar 12 and a second vertical bar 14B extending substantially orthogonally from the second end 12B of the horizontal bar 12. Each of the pair of vertical bars 14A, 14B includes a proximal end 14P and a distal end 14D opposite the proximal end 14P. The proximal end 14P of the first vertical bar 14A is affixed to the first end 12A of the horizontal bar 12. The proximal end 14P of the second vertical bar 14B is affixed to the second end 12B of the horizontal bar 12. Each of the elongated vertical bars 14A, 14B includes a first portion 20 slidably disposed within a second portion 22 forming a telescopic arrangement in which the first portion 20 is adjustable relative to the second portion 22 to increase the length of each of the pair of elongated vertical bars 14A, 14B to adjust the height of the elongated horizontal bar 12 relative to a surface. In embodiments, the pair of elongated vertical bars 14A, 14B are rectangular in cross-sectional shape. In other embodiments, the pair of elongated vertical bars 14A, 14B are circular in cross-sectional shape.

The connection between the first end 12A of the horizontal bar 12 and the proximal end 14P of the first vertical bar 14A defines a first substantially orthogonal L-shaped joint 24A. The first joint 24A includes an interior acute angle $\theta$ and an exterior acute angle $\gamma$. The connection between the second end 12B of the horizontal bar 12 and the proximal end 14P of the second vertical bar 14B defines a second substantially orthogonal L-shaped joint 24B. The second joint 24B includes an interior acute angle $\theta'$ and an exterior acute angle $\gamma'$.

The pair of horizontal rods 16 include a first rod 16A protruding substantially orthogonally outwardly from the distal end 14D of the first vertical bar 14A and a second rod 16B protruding substantially orthogonally outwardly from the distal end 14D of the second vertical bar 14B. Each of the pair of horizontal rods 16A, 16B includes a proximal end 16P and a distal end 16D opposite the proximal end 16P. The proximal end 16P of the first rod 16A is affixed to the distal end 14D of the first vertical bar 14A. The proximal end 16P of the second rod 16B is affixed to the distal end 14D of the second vertical bar 14B. The pair of horizontal rods 16A, 16B are circular in cross-sectional shape.

The connection between the distal end 14D of the first vertical bar 14A and the proximal end 16P of the first rod 16A defines a third substantially orthogonal L-shaped joint 24C including an interior acute angle $\theta''$ and an exterior acute angle $\gamma''$. The connection between the distal end 14D of the second vertical bar 14B and the proximal end 16P of the second rod 16B defines a fourth substantially orthogonal L-shaped joint 24D including an interior acute angle $\theta'''$ and an exterior acute angle $\gamma'''$.

Figure 6:
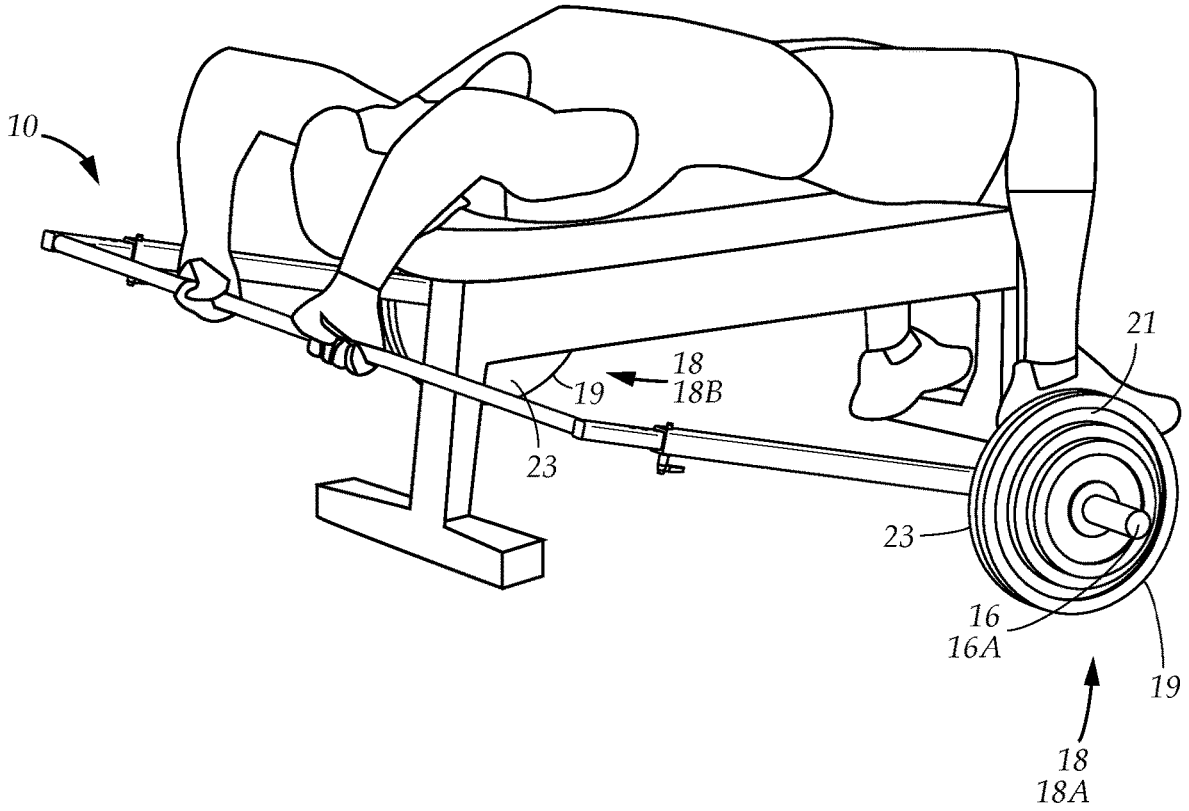
FIG. 6 is a perspective view of the squat and bench press bar in use, illustrating one manner in which the squat and bench press bar may be safely rolled out of the way if the bar is too heavy for the user according to one embodiment of the present disclosure.

Referring now to FIG. 6, with reference to FIG. 2, the pair of weights 18 include a first weight 18A for mounting onto the first rod 16A and applying a first downward force thereto and a second weight 18B for mounting onto the second rod 16B and applying a second downward force thereto. Each of the pair of weights 18A, 18B are disc-shaped defining an annular perimeter 19, which enables them to rotate upon a surface. Each of the pair of weight plates 18A, 18B includes a front face 21, a rear face 23 opposite the front face 21, and a central bore 25 extending entirely through the front face 21 and the rear face along a central horizontal axis that is orthogonal to the front face 21 and the rear face 23 of the pair of weight plates 18A, 18B. The central bore 25 is adapted to receive any one of the pair of horizontal rods 16A, 16B so as to mount onto each of the pair of horizontal rods 16A, 16B.

Each of the pair of horizontal rods 16A, 16B is adapted to receive and sustain a weight plate 18A, 18B thereon. The pair of horizontal rods 16A, 16B define a lowermost point and/or plane of the squat and bench press bar 10 when the pair of weight plates 18A, 18B are not positioned thereon. When the pair of weight plates 18A, 18B are positioned on the pair of horizontal rods 16A, 16B a portion of each of the pair of weight plates 18A, 18B is positioned below the pair of horizontal rods 16A, 16B. In this way, the pair of horizontal rods 16A, 16B define and act as an axle upon which the pair of weight plates 18A, 18B may rotate along a surface via their annular perimeter 19 to transfer the squat bench press bar 10 from one position to another as desired.

Referring back to FIG. 1 and FIG. 2, in embodiments, the elongated horizontal bar 12, the pair of elongated vertical bars 14A, 14B, and the pair of horizontal rods 16A, 16B are all coplanar. In some embodiments, each of the pair of horizontal rods 16A, 16B includes a diameter larger than a diameter of the elongated horizontal bar 12 and a diameter of the pair of elongated vertical bars 14A, 14B. In one embodiment, each of the pair of horizontal rods 16A, 16B includes a length smaller than a length of the elongated horizontal bar 12 and a length of the pair of elongated vertical bars 14A, 14B. In another embodiment, the pair of elongated vertical bars 14A, 14B include a length larger than a length of the elongated horizontal bar 12.

In embodiments, the squat and bench press bar 10 comprises a first pair of reinforcement gussets 26 for strengthening the first and second L-shaped joints 24A, 24B. The first pair of gussets 26 include a first gusset 26A spanning the area defined by the interior acute angle θ of the first L-shaped joint 24A and a second gusset 26B spanning the area defined by the interior acute angle θ' of the second L-shaped joint. The first gusset 26A reinforces the connection between the elongated horizontal bar 12 and the first vertical bar 14A by forming an added structural connection between the first end 12A of the elongated horizontal bar 12 and the proximal end 14P of the first vertical bar 14A. The second gusset 26B reinforces the connection between the elongated horizontal bar 12 and the second vertical bar 14B by forming an added structural connection between the second end 12B of the elongated horizontal bar 12 and the proximal end 14P of the second vertical bar 14B. In some embodiments, the first pair of gussets 26 are coplanar with the elongated horizontal bar 12, the pair of elongated vertical bars 14A, 14B, and the pair of horizontal rods 16A, 16B. In some embodiments, the first pair of gussets 26 are coplanar with the elongated horizontal bar 12, the pair of elongated vertical bars 14A, 14B, and the pair of horizontal rods 16A, 16B.

In embodiments, the squat and bench press bar 10 further includes a second pair of reinforcement gussets 28 for strengthening the third and fourth L-shaped joints 24C, 24D. The second pair of gussets 28 include a third gusset 28A spanning the area defined by the interior acute angle θ" of the third L-shaped joint 24C and a fourth gusset 28B spanning the area defined by the interior acute angle θ'" of the fourth L-shaped joint 24D. The third gusset 28A reinforces the connection between the first vertical bar 14A and the first rod 16A by forming an added structural connection between the distal end 14D of the first vertical bar 14A and the proximal end 16P of the first rod 16A. The fourth gusset 28B reinforces the connection between the second vertical bar 14B and the second rod 16B by forming an added structural connection between the distal end 14D of the second vertical bar 14B and the proximal end 16P of the second rod 16B. In some embodiment, the second pair of gussets 28 are coplanar with the first pair of gussets 26, the elongated horizontal bar 12, the pair of elongated vertical bars 14A, 14B, and the pair of horizontal rods 16A, 16B.

Figure 3:
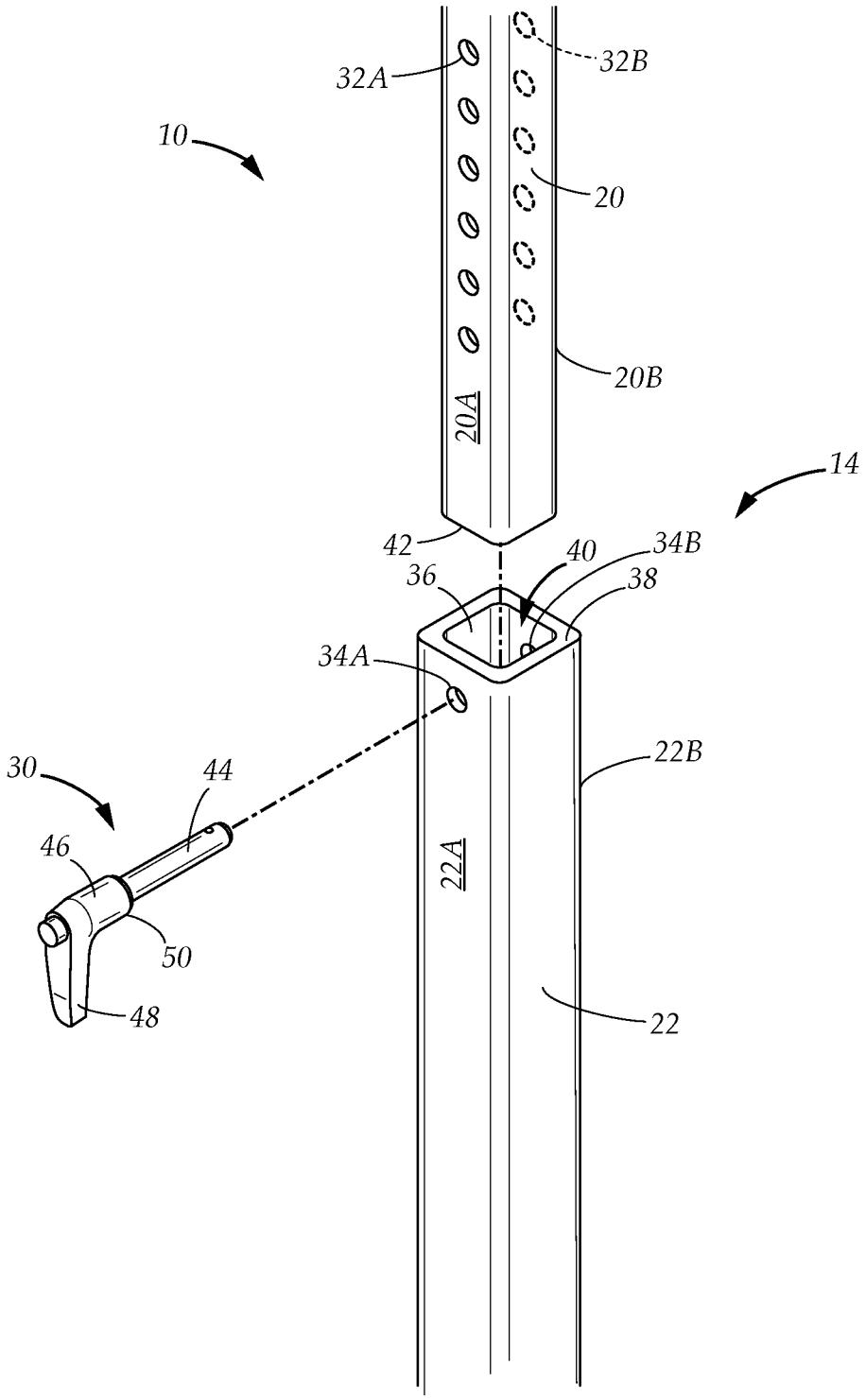
FIG. 3 is a close-up exploded view of a telescoping arm of the squat and bench press bar, illustrating the adjustability of the telescoping arms according to one embodiment of the present disclosure.
Figure 4:
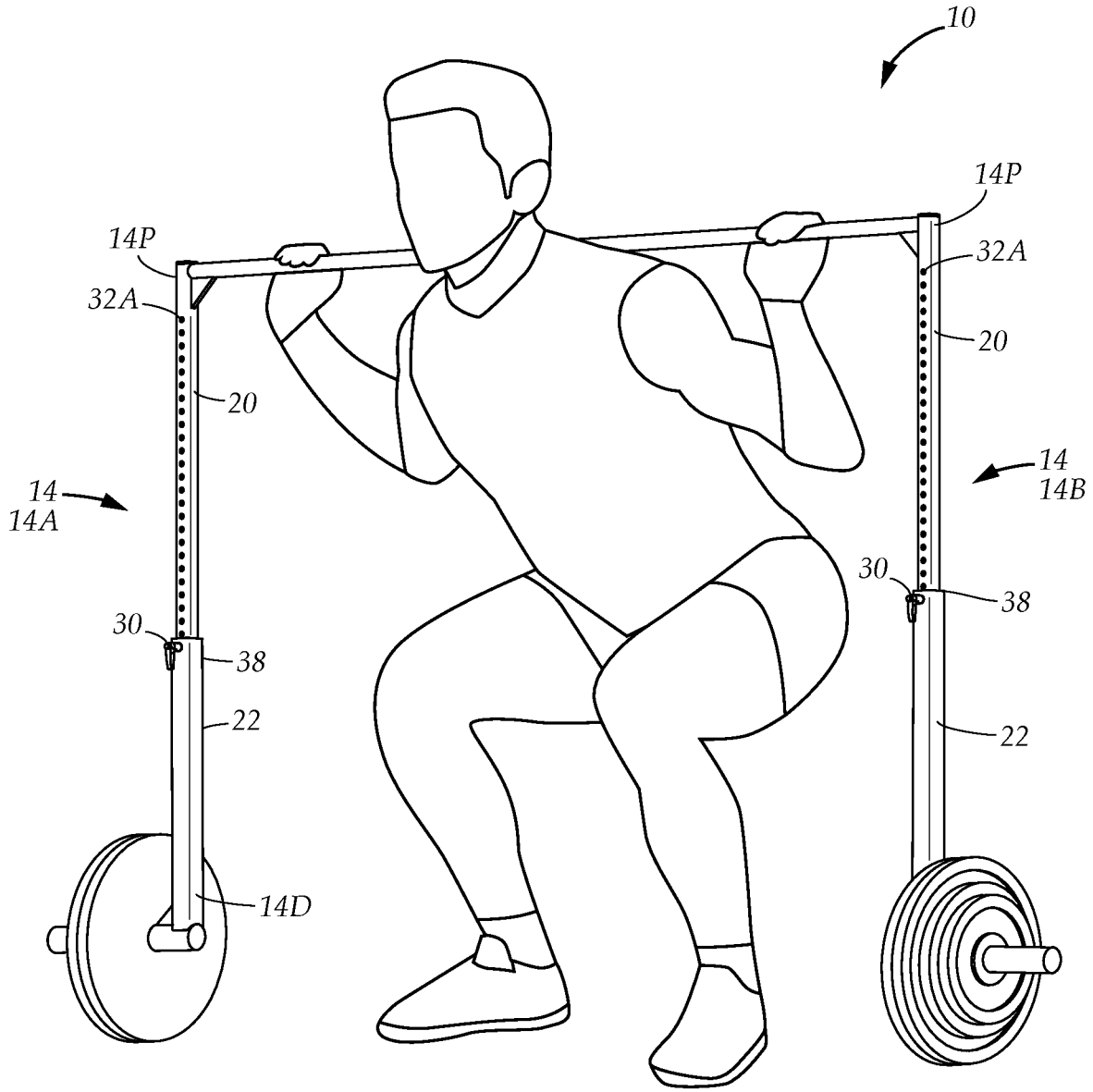
FIG. 4 is a perspective view of the squat and bench press bar in use as a squatting bar, illustrating one manner in which the squat and bench press bar may be adjusted to accommodate use as a squat bar for squatting according to one embodiment of the present disclosure.
Figure 5:
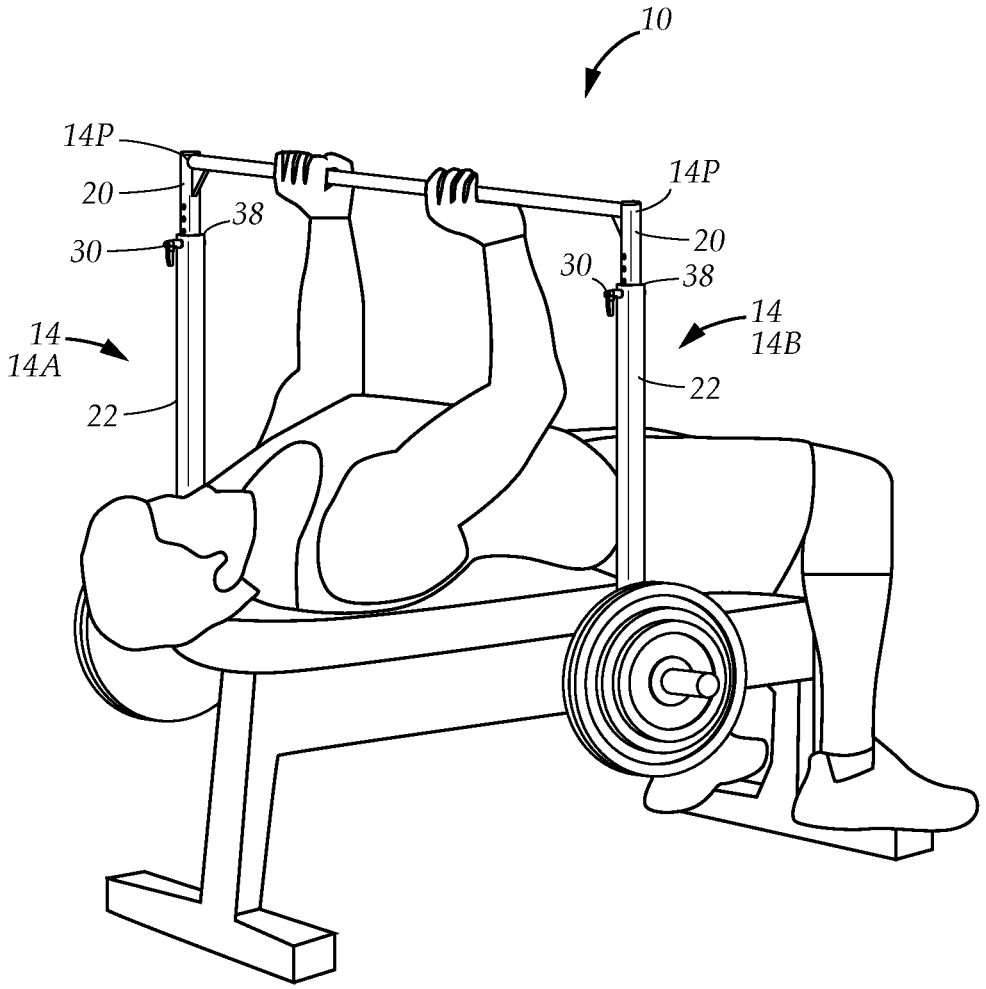
FIG. 5 is a perspective view of the squat and bench press bar in use as a bench press bar, illustrating one manner in which the squat and bench press bar may be adjusted to accommodate use as a bench press bar for bench pressing according to one embodiment of the present disclosure.

Referring now to FIG. 3, FIG. 4, and FIG. 5, with reference to FIG. 2, the squat and bench press bar 10 further comprises a locking pin 30 for removably engaging the first portion 20 and the second portion 22 to selectively adjust the position of first portion 20 with respect to the second portion 22. In this way, a user may adjust the length of the pair of vertical bars 14A, 14B to a desired length and selectively secure the first portion 20 in position with respect to the second portion 22 to lock the pair of vertical bars 14A, 14B in the desired length. This ultimately affects the height of the squat and bench press bar 10 for the purposes of adjusting the bar 10 to a squatting configuration, as shown in FIG. 4, and a bench-pressing configuration, as shown in FIG. 5. Note, the length of the pair of vertical bars 14A, 14B is greater in the squatting configuration than in the bench-pressing configuration.

The first portion 20 of each of the pair of elongated vertical bars 14A, 14B includes a front surface 20A and a rear surface 20B opposite the front surface 20A. The front surface 20A includes a plurality of front apertures 32A extending entirely through the front surface 20A so as to receive the locking pin 30 therethrough. The rear surface 20B includes a plurality of rear apertures 32B extending entirely through the rear surface 20B so as to receive the locking pin 30 therethrough. The plurality of front apertures 32A and the plurality of rear apertures 32B are arranged longitudinally along the length of the first portion 20. The plurality of front apertures 32A are aligned with the plurality of rear apertures 32B such that any one of the front apertures 32A and a corresponding rear aperture 32B are configured to simultaneously receive the locking pin 30 horizontally therethrough at one time, so as to secure the first portion 20 in position with respect to the second portion 22.

The second portion 22 of each of the pair of elongated vertical bars 14A, 14B includes a front surface 22A and a rear surface 22B opposite the front surface 22A. The front surface 22A includes a front aperture 34A extending entirely through the front surface 22A so as to receive the locking pin 30 therethrough. The rear surface 22B including a rear aperture 34B extending entirely through the rear surface 22B as as to receive the locking pin 30 therethrough. The front aperture 34A is aligned with the rear aperture 34B such that the front aperture 34A and the rear aperture 34B are configured to simultaneously receive the locking pin 30 horizontally therethrough at one time. The front aperture 34A and the rear aperture 34B correspond to the plurality of front apertures 32A and the plurality of rear apertures 32B such that the front aperture 34A and rear aperture 34B may align with any one of the plurality of front apertures 32A and the corresponding rear aperture 32B to simultaneously receive the locking pin 30 horizontally through the front aperture 34A, any one of the plurality of front apertures 32A, a corresponding rear apertures of the plurality of rear apertures 32B, and the rear aperture 34B. In this way, the locking pin 30 may engage the front aperture 34A, any one of the plurality of front apertures 32A, the plurality of rear apertures 32B, and the rear aperture 34B to secure the first portion 20 in position with respect to the second portion 22 and lock the pair of vertical bars 14A, 14B in position.

The second portion 22 of each of the pair of vertical bars 14A, 14B includes a longitudinally bored interior 36 and a locking end 38 opposite the distal end 14D. The locking end 38 includes the front aperture 34A, the rear aperture 34B, and an opening 40 providing access to the interior 36. The first portion 20 of each of the pair of vertical bars 14A, 14B includes an adjustment end 42 opposite the proximal end 14P. The adjustment end 42 is slidably disposed within the locking end 38 of the second portion 22 via the opening 40. The first portion 20 is slidably adjustable with respect to the second portion 22 via the locking end 38. Note, the first portion 20 of each of the pair of vertical bars 14A, 14B telescopes out of the second portion 22 more in the squatting configuration than in the bench-pressing configuration.

In embodiments, the locking pin 30 comprises a pin portion 44 for insertion and engagement with the apertures 32A, 32B, 34A, 34B of the pair of vertical bars 14A, 14B, a collar 46 extending annularly around an end of the pin portion 44, and a lever 48 protruding outwardly from the collar 46. The collar 46 includes a stop shoulder 50 having a diameter larger than a diameter of the apertures 32A, 32B, 34A, 34B of the pair of vertical bars 14A, 14B. In this way, the stop shoulder 50 prevents the locking pin 30 from inadvertently sliding into an interior of the first portion 20 or second portion 22 and causing the first portion 20 or second portion 20 to become loose with respect to each other. The lever 48 enables a user to grasp and maneuver the locking pin 30 to remove and/or insert the locking pin 30 into the pair of vertical bars 14A, 14B.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly. The term "substantially" is defined as at least 95% of the term being described and/or within a tolerance level known in the art and/or within 5% thereof.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented an adjustable two-in-one safety squat and bench press bar. The disclosure is illustrated by example in the drawing figures, and throughout the written description. It should be understood that numerous variations are possible, while adhering to the inventive concept. Such variations are contemplated as being a part of the present disclosure.

What is claimed is:

1. A squat and bench press bar, comprising:

an elongated horizontal bar including a first end and a second end, the first end opposite the second end;

a pair of elongated vertical bars including a first vertical bar extending orthogonally outwardly from the first end of the horizontal bar and a second vertical bar extending orthogonally outwardly from the second end of the horizontal bar, the pair of elongated vertical bars each including a proximal end and a distal end, the proximal end opposite the distal end, the proximal end of the first vertical bar affixed to the first end of the horizontal bar, the proximal end of the second vertical bar affixed to the second end of the horizontal bar, each of the elongated vertical bars including a first portion slidably disposed within a second portion forming a telescopic arrangement in which the first portion is adjustable relative to the second portion to increase a length of each of the pair of elongated vertical bars to adjust the height of the elongated horizontal bar relative to a surface, the second portion of each of the pair of elongated vertical bars includes an interior and a locking end opposite the distal end of the pair of elongated vertical bars, the locking end including a front aperture, a rear aperture, and an opening providing access to the interior, the first portion of each of the pair of elongated vertical bars includes an adjustment end opposite the proximal end of the pair of elongated vertical bars, the adjustment end slidably disposed within the locking end of the second portion via the opening, the first portion slidably adjustable with respect to the second portion via the locking end;

a first pair of reinforcement gussets;

a locking pin for removably engaging the first portion and the second portion to selectively adjust the position of first portion with respect to the second portion to adjust the length of the pair of elongated vertical bars and to selectively secure the first portion in position with respect to the second portion to lock the pair of elongated vertical bars at a desired length, the first portion of each of the pair of elongated vertical bars includes a front surface and a rear surface, the front surface opposite the rear surface, the front surface further includes a plurality of front apertures extending entirely through the front surface to receive the locking pin therethrough, the rear surface including a plurality of rear apertures extending entirely through the rear surface to receive the locking pin therethrough, the plurality of front apertures and the plurality of rear apertures arranged longitudinally along the length of the first portion, the plurality of front apertures aligned with the plurality of rear apertures such that any one of the front apertures and a corresponding rear aperture are configured to receive the locking pin horizontally therethrough to secure the first portion in position with respect to the second portion, the second portion of each of the pair of elongated vertical bars includes a front surface and a rear surface, the front surface opposite the rear surface, the front surface including the front aperture extending entirely through the front surface to receive the locking pin therethrough, the rear surface including the rear aperture extending entirely through the rear surface to receive the locking pin therethrough, the front aperture aligned with the rear aperture such that the front aperture and the rear aperture are configured to receive the locking pin horizontally therethrough, the front aperture and the rear aperture corresponding to the plurality of front apertures and the plurality of rear apertures such that the front aperture and rear aperture may align with any one of the plurality of front apertures and the corresponding rear aperture to removably receive the locking pin horizontally therethrough and secure the first portion in position with respect to the second portion and lock the pair of elongated vertical bars in position;

a pair of horizontal rods including a first rod protruding orthogonally outwardly from the distal end of the first vertical bar and a second rod protruding orthogonally outwardly from the distal end of the second vertical bar, each of the pair of horizontal rods including a proximal end and a distal end, the proximal end opposite the distal end, the proximal end of the first rod affixed to the distal end of the first vertical bar, the proximal end of the second rod affixed to the distal end of the second vertical bar, each of the pair of horizontal rods includes a diameter larger than a diameter of the elongated horizontal bar and a diameter of the pair of elongated vertical bars, and each of the pair of horizontal rods further includes a length smaller than a length of the elongated horizontal bar and a length of the pair of elongated vertical bars; and a pair of weight plates for mounting onto the pair of horizontal rods, each of the pair of weights are disc-shaped defining an annular perimeter which enables each of the pair of weight plates to rotate upon the surface, each of the pair of weight plates further includes a front face, a rear face, the front face opposite the rear face, and a central bore extending entirely through the front face and the rear face along a central horizontal axis that is orthogonal to the front face and the rear face, the central bore adapted to receive any one of the pair of horizontal rods therethrough;

wherein:

the elongated horizontal bar, the pair of elongated vertical bars, and the pair of horizontal rods are coplanar;

the first end of the horizontal bar and the proximal end of the first vertical bar form a connection therebetween which defines a first L-shaped orthogonal joint including an interior angle and an exterior angle, and the second end of the horizontal bar and the proximal end of the second vertical bar form a connection therebetween which defines a second L-shaped orthogonal joint;

the first pair of reinforcement gussets includes a first gusset spanning the area defined by the interior angle of the first L-shaped orthogonal joint to connect the first end of the elongated horizontal bar to the proximal end of the first vertical bar and strengthen the first L-shaped orthogonal joint, and a second gusset spanning the area defined by the interior angle of the second L-shaped orthogonal joint to connect the second end of the elongated horizontal bar to the proximal end of the second vertical bar to strengthen the second L-shaped orthogonal joint; and each of the pair of horizontal rods is adapted to receive and sustain a weight plate of the pair of weight plates thereon, the pair of horizontal rods defining a lowermost point of the squat and bench press bar such that when the pair of weight plates are positioned on the pair of horizontal rods a portion of each of the pair of weight plates is positioned below the pair of horizontal rods and the pair of horizontal rods define an axle upon which the pair of weight plates may rotate along the surface to transfer the squat bench press bar from one position to another as desired.

2. The squat and bench press bar of claim 1, wherein the first pair of reinforcement gussets are coplanar with the elongated horizontal bar, the pair of elongated vertical bars, and the pair of horizontal rods.

3. The squat and bench press bar of claim 2, wherein:

the distal end of the first vertical bar and the proximal end of the first rod form a connection therebetween which defines a third L-shaped orthogonal joint including an interior angle and an exterior angle; and the distal end of the second vertical bar and the proximal end of the second rod form a connection therebetween which defines a fourth L-shaped orthogonal joint including an interior angle and an exterior angle.

4. The squat and bench press bar of claim 3, further comprising a second pair of reinforcement gussets to strengthen the third and fourth L-shaped orthogonal joints, the second pair of reinforcement gussets including a third gusset spanning the area defined by the interior angle of the third L-shaped orthogonal joint to connect the distal end of the first vertical bar to the proximal end of the first rod, and a fourth gusset spanning the area defined by the interior angle of the fourth L-shaped orthogonal joint to connect the distal end of the second vertical bar to the proximal end of the second rod.

5. The squat and bench press bar of claim 4, wherein the second pair of reinforcement gussets are coplanar with the first pair of reinforcement gussets, the elongated horizontal bar, the pair of elongated vertical bar, and the pair of horizontal rods.

6. The squat and bench press bar of claim 5, wherein the locking pin comprises a stop shoulder having a diameter larger than a diameter of the plurality of front apertures and the plurality of rear apertures of the first portion and a diameter of the front aperture and the rear aperture of the second portion to prevent the locking pin from inadvertently sliding into an interior of the first portion or second portion and causing the first portion or second portion to become loose with respect to each other.

7. The squat and bench press bar of claim 6, wherein the locking pin further comprises an end having a lever protruding outwardly therefrom, the lever enabling a user to grasp and maneuver the locking pin.

8. The squat and bench press bar of claim 7, wherein the elongated horizontal bar is circular in cross-sectional shape, the pair of elongated vertical bars including the first portion and the second portion are rectangular in cross-sectional shape, and the pair of horizontal rods are circular in cross-sectional shape.

* * * * *